US008371479B2

(12) United States Patent
Luft

(10) Patent No.: US 8,371,479 B2
(45) Date of Patent: Feb. 12, 2013

(54) CLEANING TOOL

(75) Inventor: Lee Thomas Luft, Kewaunee, WI (US)

(73) Assignee: Green Bay Converting, Inc., Green Bay, WI (US)

( * ) Notice: Subject to any disclaimer, the term of this patent is extended or adjusted under 35 U.S.C. 154(b) by 569 days.

(21) Appl. No.: 12/543,320

(22) Filed: Aug. 18, 2009

(65) Prior Publication Data

US 2011/0042486 A1 Feb. 24, 2011

(51) Int. Cl.
*B05B 9/03* (2006.01)

(52) U.S. Cl. ..... 222/192; 222/383.1; 222/324; 239/289; 239/303; 401/195; 206/226; 221/96

(58) Field of Classification Search ..... 222/192, 222/129, 130, 131, 183, 320, 321.1, 321.7, 222/321.8, 323–325, 383.1; 239/289, 303; 401/195; 206/226, 225; 221/96; 134/198
See application file for complete search history.

(56) References Cited

U.S. PATENT DOCUMENTS 4,436,224 A * 3/1984 McInerny ..... 222/183
4,516,676 A * 5/1985 Cournoyer ..... 206/226
4,901,889 A * 2/1990 Mitchell ..... 222/153.11
D307,843 S 5/1990 Parshall
5,035,321 A 7/1991 Denton
D363,214 S 10/1995 Parola et al.
5,671,872 A * 9/1997 Daniels, Jr. ..... 222/192
5,763,984 A 6/1998 Day
5,799,895 A * 9/1998 Michaud et al. ..... 242/423
5,819,989 A 10/1998 Saraceni
D406,976 S 3/1999 Baggett
6,216,920 B1 4/2001 Baggett
6,405,972 B1 6/2002 Wakam
6,431,405 B2 8/2002 Irwin
6,644,563 B2 11/2003 Presson
6,883,989 B2 4/2005 Kushner et al.
7,354,598 B2 4/2008 Masting
7,743,947 B2 * 6/2010 Flasch ..... 222/192
2004/0251265 A1 12/2004 FitzSimons et al.
2007/0020033 A1 * 1/2007 Walsh ..... 401/195

* cited by examiner

*Primary Examiner* — J. Casimer Jacyna
(74) *Attorney, Agent, or Firm* — Merchant & Gould P.C.

(57) ABSTRACT

An embodiment of the present disclosure provides an integrated spray and wipe system and a method of using such a system. In one embodiment the system includes a fluid reservoir that extends through the center of a roll of cleaning material (e.g., paper towel roll). The tool houses cleaning fluid and cleaning wipes and, therefore, can be used to dispense liquid or cleaning wipes as needed.

12 Claims, 6 Drawing Sheets

CLEANING TOOL

TECHNICAL FIELD

A tool for spraying cleaning fluid and dispensing cleaning wipes and a method of using the same.

BACKGROUND

Typically, spray bottles and cleaning wipe dispensers are separate stand-alone devices. More recently integrated spray and wipe systems have been developed. For example, see U.S. patent application Ser. No. 11/825,134 filed on Jul. 3, 2007, which is hereby incorporated by reference in its entirety.

SUMMARY

An embodiment of the present disclosure provides an integrated spray and wipe system and a method of using such a system. In one embodiment, the system includes a fluid reservoir that extends through the center of a roll of cleaning material (e.g., paper towel roll). The tool houses cleaning fluid and cleaning wipes and, therefore, can be used to dispense liquid or cleaning wipes as needed.

DETAILED DESCRIPTION

Figure 1:
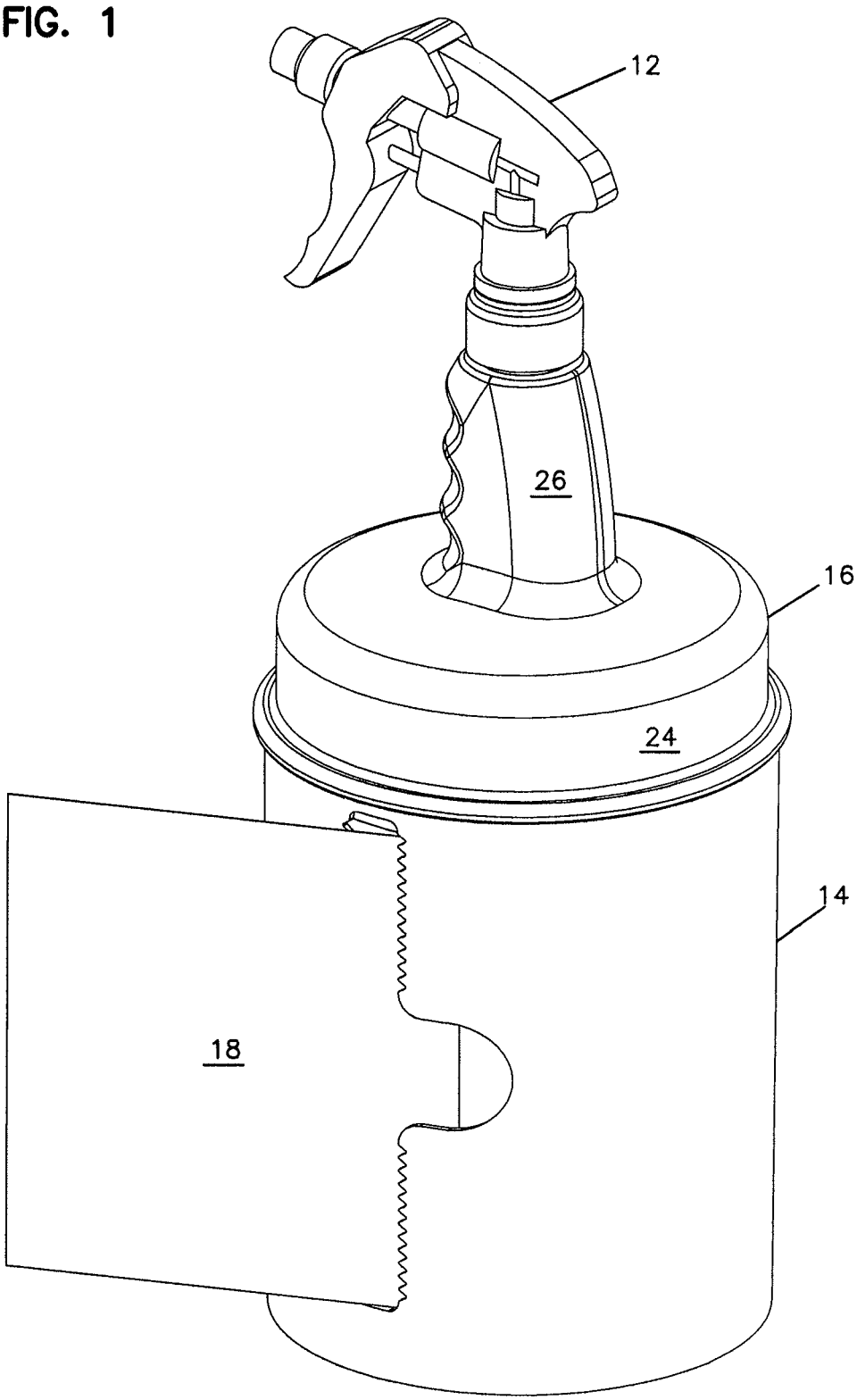
FIG. 1 is a top perspective view of an embodiment of the cleaning tool in accordance with the present disclosure.
Figure 2:
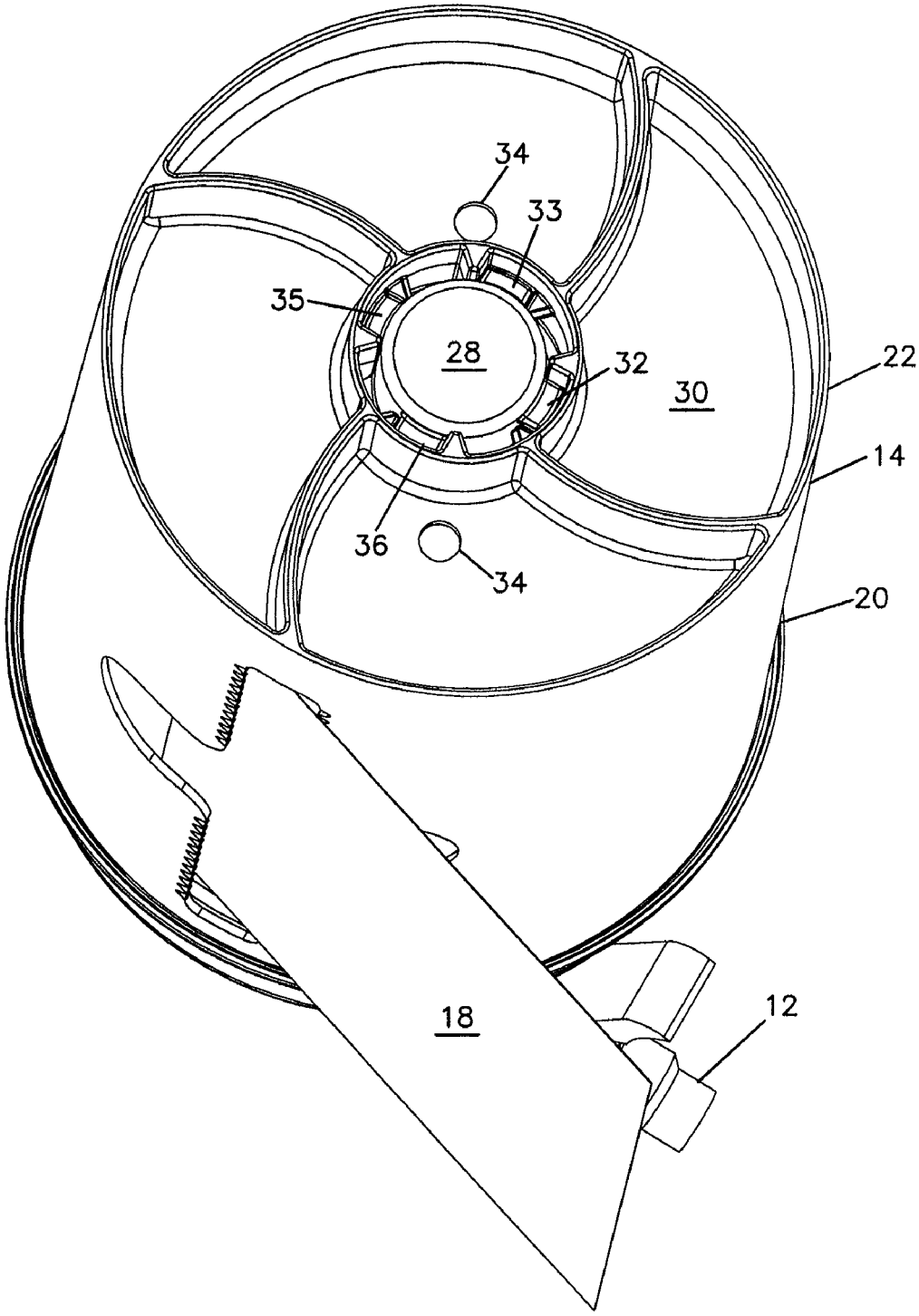
FIG. 2 is a bottom perspective view of an embodiment of the cleaning tool in accordance with the present disclosure.
Figure 3:
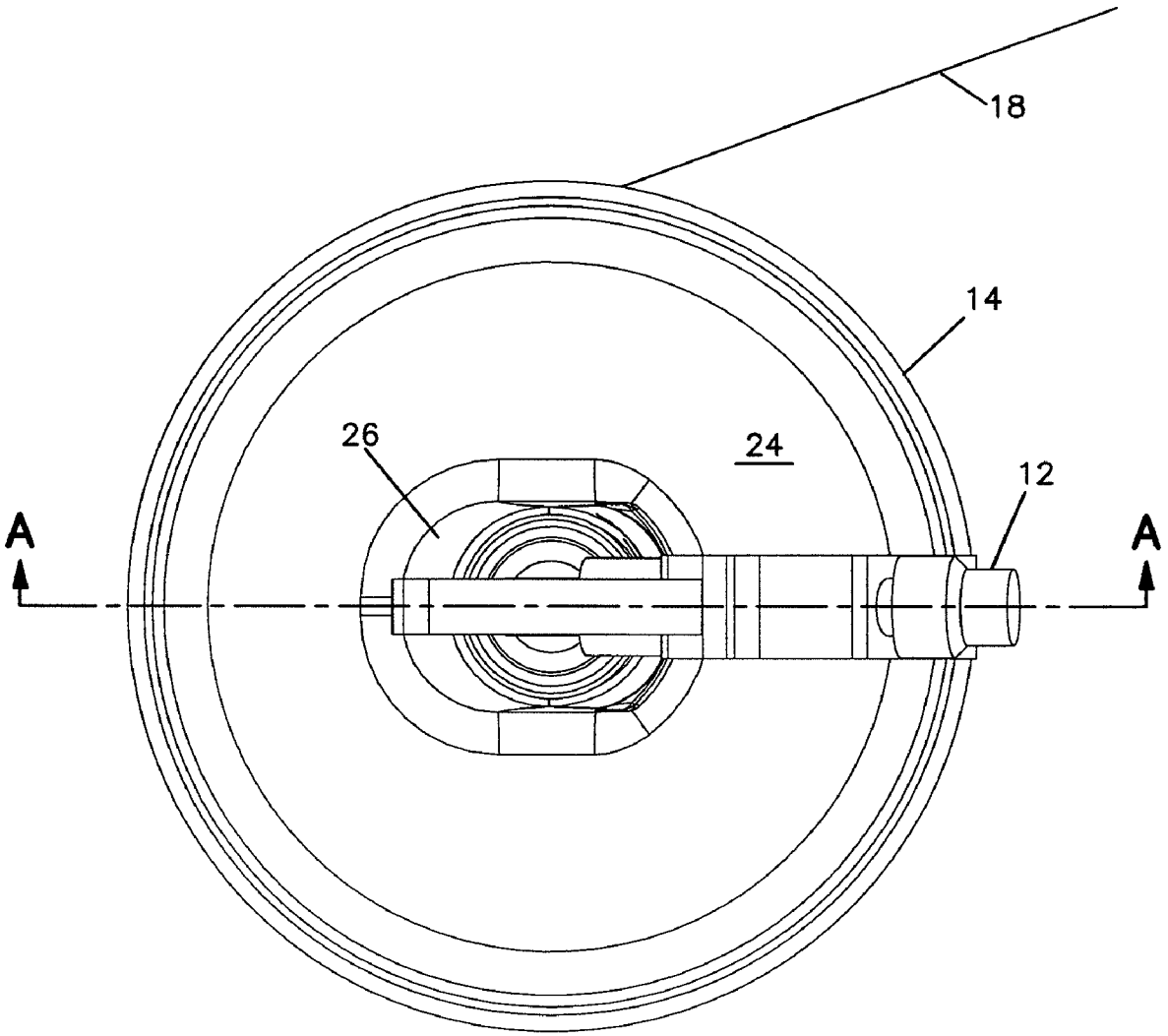
FIG. 3 is a top view of the reservoir of the cleaning tool of FIG. 1.
Figure 4:
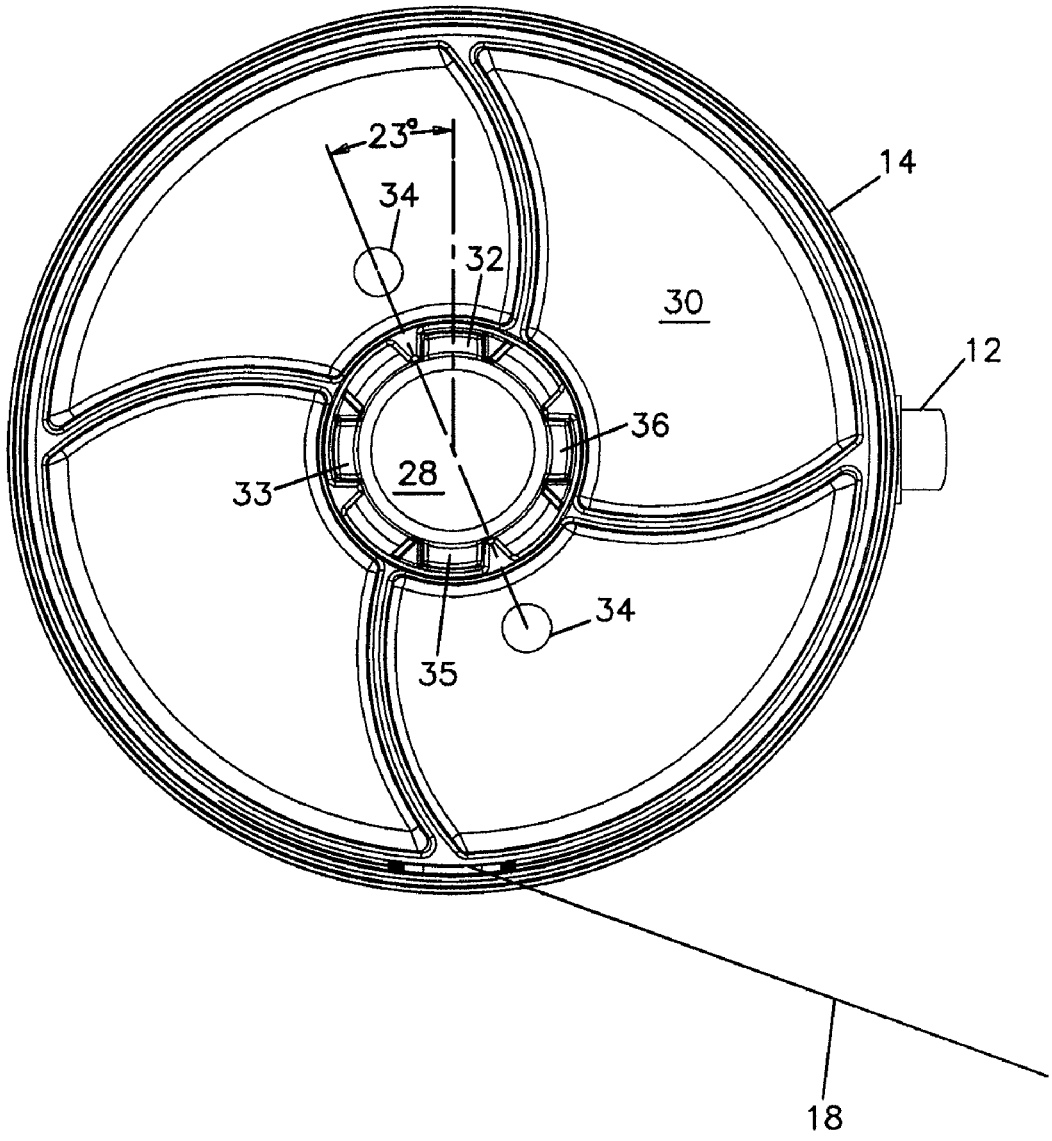
FIG. 4 is a bottom view of the reservoir of the cleaning tool of FIG. 1.
Figure 5:
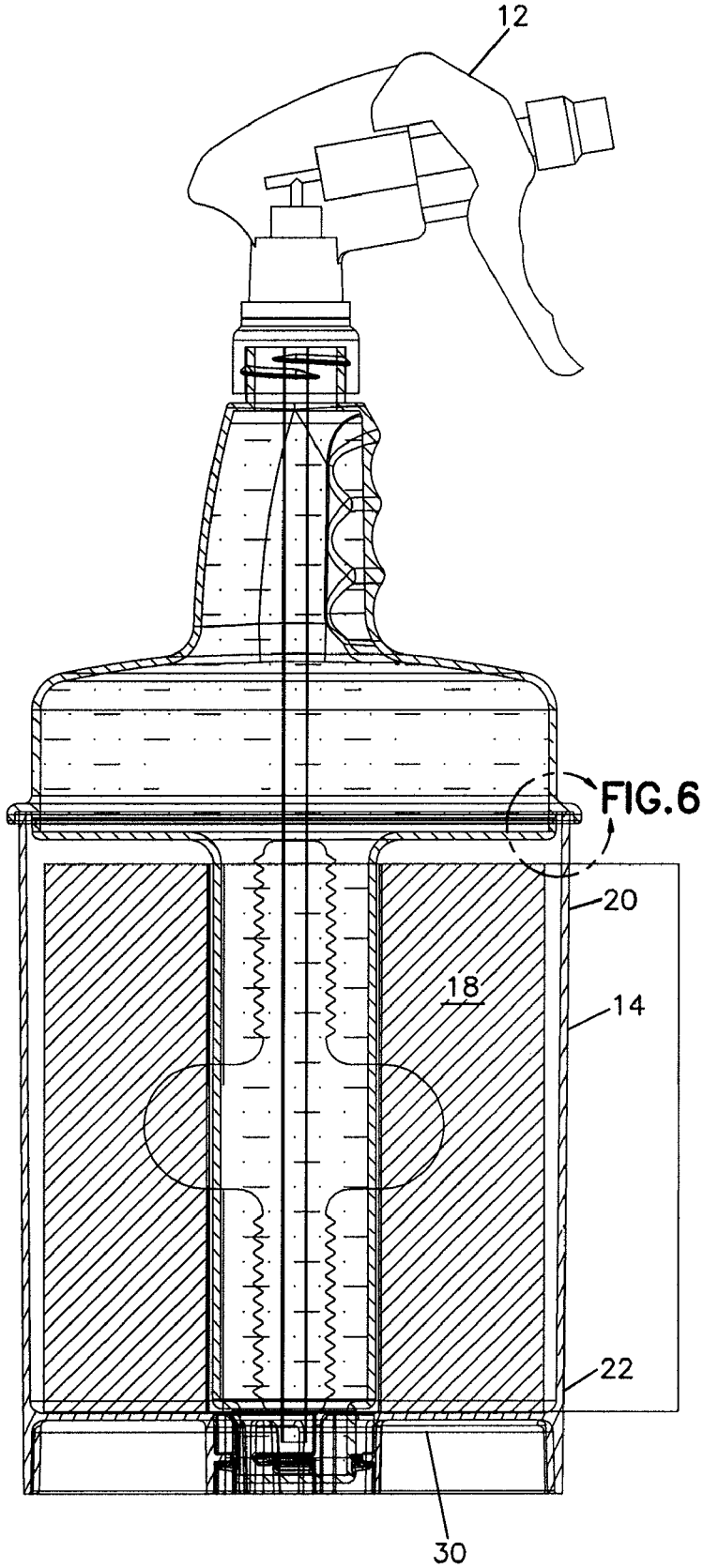
FIG. 5 is a cross-sectional view of the cleaning tool along lines 5-5 of FIG. 3.

Referring to FIGS. 1-5, an alternative view of an embodiment of a cleaning device according to the present disclosure is shown. The cleaning device 10 includes a spray head 12 for distributing cleaning fluid, a housing 14 for housing a cleaning/drying material 18 (e.g., a cylindrical roll or cube of paper towels, glass wipes, cleaning cloths, etc.), and a reservoir 16 for containing fluid (e.g., cleaning chemicals). FIGS. 1-5 depict the cleaning device 10 with the housing 14 loaded with a cleaning material 18. The cleaning material in the depicted embodiment is a roll of paper towels. However, it should be appreciated that many alternative forms and types of cleaning material are also possible.

In the depicted embodiment the housing 14 includes an upper end 20 and a lower end 22. The upper end 20 is sized to receive a cylindrical roll of cleaning wipes. In the depicted embodiment the housing 14 is cylindrical and the upper end 20 includes a circular aperture for receiving the cleaning material 18. In the depicted embodiment the housing 14 is configured to protect the majority of the cleaning/drying materials 18 from being contaminated (exposed to water, dirt, etc.). In particular, the housing 14 includes a vertical slot with serrations on opposed vertical edges. The slot exposes the cleaning material located in the housing 14 and is configured so that the cleaning material can be dispensed through the slot by pulling the cleaning material outwardly and towards either of the serrated edges.

In the depicted embodiment the fluid reservoir 16 includes an enlarged portion 24 located between a handle portion 26 and an elongated portion 28 each having an interior volume that is configured to house liquid. In the depicted embodiment, the center of gravity of the cleaning device 10 is relatively near the handle portion 26 of the reservoir 16. In particular, the majority of the volume of the fluid reservoir 16 is within 5 inches from a center of the handle portion. The majority of the volume of the fluid reservoir 16 is within 8 inches from the spray head. The disclosed arrangement results in a cleaning device 10 that is easy to use as it reduces wrist strain.

The spray head 12 is connected to the handle portion 26 of the fluid reservoir 16. In the depicted embodiment the spray head 12 is threaded to the upper end of the handle portion 26. The enlarged portion 24 of the fluid reservoir 16 abuts the upper end 20 of the housing 14, and the elongated portion 28 extends through the housing 14 and engages the lower end 22 of the housing, thereby securing the housing 14 to the fluid reservoir 16 with the cleaning wipes 18 therein. In the depicted embodiment the elongated portion extends through the center of the housing and through the cylindrical roll of cleaning wipes.

In particular, the lower end of the elongated portion 28 is secured to a bottom surface 30 at the lower end 22 of the housing 14. In the depicted embodiment, tabs 32, 33, 35, 36 extend radially from the lower end of the elongated portion 28 and are configured and arranged such that rotating the reservoir 16 ninety degrees relative to the housing 14 secures the reservoir 16 to the housing 14. In the depicted embodiment, the bottom surface 30 of the housing 14.includes stops 34 that engage the cleaning material 18 in the housing and limit the free movement of the cleaning material 18 therein. In the depicted embodiment, the stops 34 are secured to stop receiving apertures located in the bottom surface 30 of the housing 14. In the depicted embodiment the stops 34 are rubber plugs and avoid inadvertent retraction or dispensing of the cleaning material 18. It should be appreciated that stops of different hardness, shapes, and sizes can be changed out depending of the friction characteristics desired for a particular application (paper towels, wet wipes, synthetic wipes, etc.).

In the depicted embodiment, the bottom surface 30 includes curved ribs that extend radially from the center to the edge of the housing. The ribs aid in the removal and reinstallation of the housing to the reservoir by allowing the users fingers to locate around the curved ribs to stabilize and rotate the housing. The curved ribs also add strength to the lower end 22 of the housing thereby improving the housing's ability to withstand the impact resulting from the cleaning device 10 being dropped onto hard surfaces.

In the depicted embodiment the set up and assembly of the cleaning device 10 includes the steps of pouring cleaning fluid into a reservoir 16, connecting a spray head 12 to the reservoir 16, positioning a roll of cleaning material 18 within a housing 14, and connecting the reservoir 16 to the housing 14. The cleaning device 10 is configured such that the housing 14 can be loaded and unloaded with cleaning material 18 without needing to remove the spray head 12. The spray head 12 can be connected to the reservoir 16 before or after the reservoir 16 is connected to the housing 14.

In the depicted embodiment the housing 14 is separated from the reservoir 16 by rotating the reservoir 16 and the housing 14 relative to each other (e.g., 90 degrees) thereby disengaging the locking mechanisms (e.g., tabs 32, 33, 35, 36 from the bottom surface 30). The housing 14 is then pulled away from the reservoir 16 in a direction away from the spray head 12.

Figure 6:
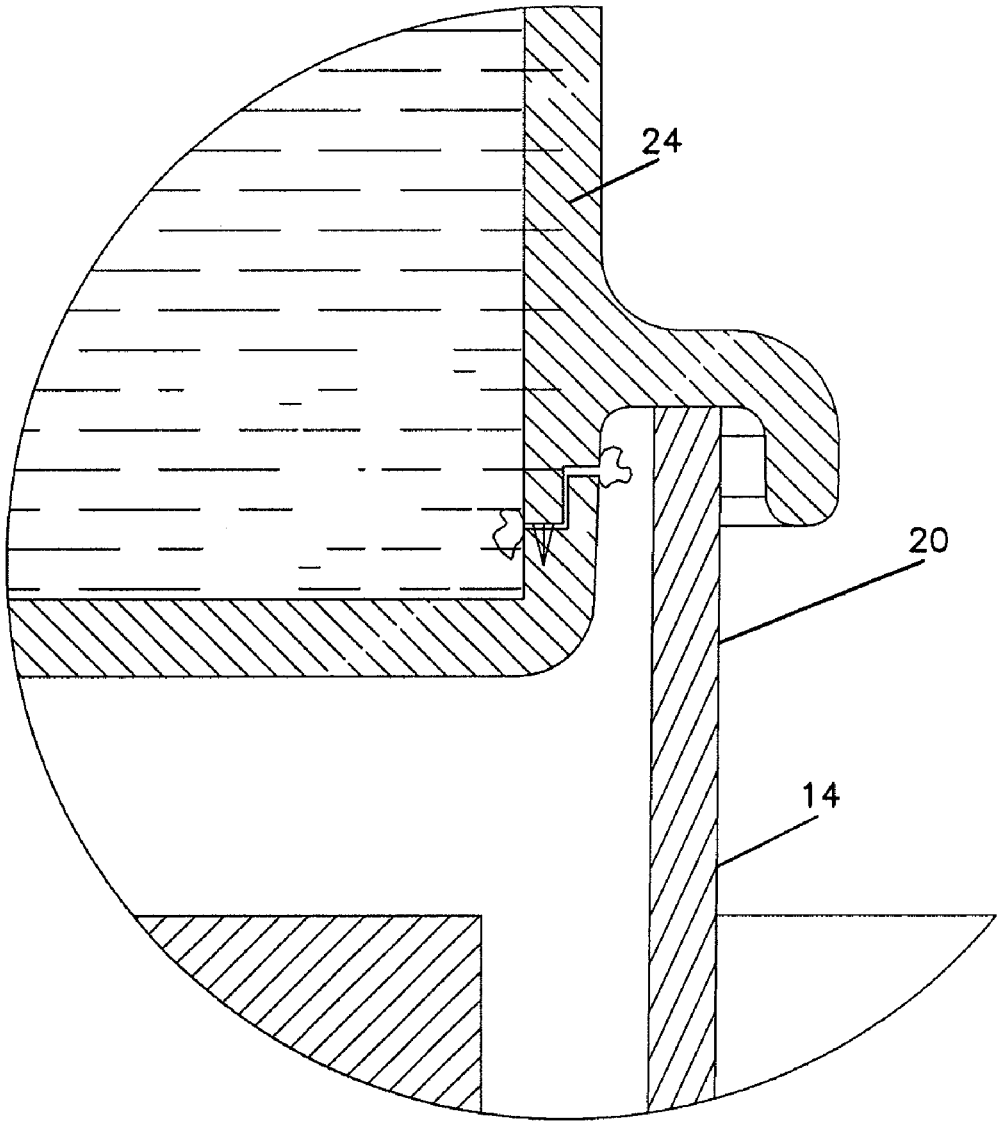
FIG. 6 is a enlarged view of a portion of FIG. 5.

Referring to FIG. 6, in the depicted embodiment the fluid reservoir 16 and housing 14 abut each other at the upper end 20 of the housing 14. The upper edge of the housing fits within a periphery channel on the enlarged portion 24 of the reservoir 16. The cleaning device 10 of the depicted embodiment is injection molded of a plastic material (e.g., polypropylene). Is should be appreciated that many other alternative embodiments are also possible.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A cleaning device comprising:

a housing including a cylindrical body that defines an open upper end and a closed lower end, the open upper end is sized to receive a cylindrical roll of cleaning wipes and the closed lower end including a bottom portion;

a fluid reservoir including an enlarged portion between a handle portion and an elongated portion, wherein the enlarged portion abuts the upper end of the housing and the elongated portion extends through the housing and includes radially extending tabs that engage the bottom portion of the closed lower end of the housing thereby securing the enlarged portion of the fluid reservoir in place against the open upper end of the housing; and a spray head connected to the handle portion of the fluid reservoir.

2. The device of claim 1, wherein the majority of the volume of the fluid reservoir is within 5 inches from a center of the grip portion.

3. The device of claim 1, wherein the majority of the volume of the fluid reservoir is within 8 inches from the spray head.

4. The device of claim 1, wherein the fluid reservoir is configured such that cleaning fluid therein is kept close to the user's grip to reduce stress on the user's hand and wrist.

5. The device of claim 1, wherein the enlarged portion of the fluid reservoir is cylindrical and configured to contain fluid.

6. The device of claim 5, wherein the handle portion of the fluid reservoir is configured to contain fluid.

7. The device of claim 6, wherein the elongated portion of the fluid reservoir is configured to contain fluid.

8. The device of claim 1, wherein the lower end of the elongated portion is secured to the bottom end portion of the housing by rotating the lower end of the elongated portion relative to the bottom end portion of the housing.

9. The device of claim 1, wherein the tabs engage the lower end of the housing by rotating the reservoir 90 degrees relative to the housing.

10. The device of claim 1, wherein the lower end of the housing includes rubber members that extend towards the upper end that are configured to control the movement of cleaning material in the housing.

11. A cleaning device comprising:

a cylindrical housing including an upper end and a lower end, the upper end being sized to receive a cylindrical roll of cleaning wipes, the lower end being configured to support one end of the cylindrical roll of cleaning wipes;

a fluid reservoir including an enlarged cylindrical portion arranged between a handle portion and an elongated portion, wherein the enlarged cylindrical portion abuts the upper end of the housing and the elongated portion extends through the center of the housing and the cylindrical roll of cleaning wipes, wherein the elongated portion is connected to the lower end of the housing via a quick connect locking mechanism wherein release of the quick connect locking mechanism releases the fluid reservoir from the cylindrical housing; and a spray head connected to the handle portion of the fluid reservoir;

wherein the handle portion, the elongated portion, and the enlarged cylindrical portion are configured to contain liquid.

12. The cleaning device of claim 11, further comprising a longitudinal slot having opposed serrated edges configured such that cleaning material within the housing can be dispensed therefrom in either the clockwise or counterclockwise direction.

* * * * *